US005528324A

United States Patent [19]

Newmann

[11] Patent Number: 5,528,324

[45] Date of Patent: Jun. 18, 1996

[54] ANIMATION DEVICE

[76] Inventor: Edward Newmann, 2044 N. Oak Park Ave., Chicago, Ill. 60635

[21] Appl. No.: 301,798

[22] Filed: Sep. 7, 1994

[51] Int. Cl.[6] ..... G03B 25/00

[52] U.S. Cl. ..... 352/101

[58] Field of Search ..... 352/101, 99, 2, 352/244, 98, 100

[56] References Cited

U.S. PATENT DOCUMENTS

| | | | |
|---|---|---|---|
| 1,141,449 | 6/1915 | Eppler | 242/545.1 |
| 1,178,566 | 4/1916 | Wright | 242/128 |
| 2,607,263 | 8/1952 | Lazarus . | |
| 2,940,884 | 6/1960 | White . | |
| 3,545,192 | 12/1970 | Hickman | 57/71 |
| 3,559,917 | 2/1971 | Mackie | 242/159 |
| 4,717,086 | 1/1988 | Crow | 242/47 |

*Primary Examiner*—Michael L. Gellner
*Assistant Examiner*—Christopher E. Mahoney
*Attorney, Agent, or Firm*—Fitch, Even, Tabin & Flannery

[57] ABSTRACT

A device for displaying an animated motion picture in which an elongated web of material is provided for receiving images in predetermined, spaced relation. The web may be supported in wound configuration on a reel, and the predetermined, spaced relation of the images is such that the images line up substantially behind one another when the web is wound on the reel. The web has a trailing end disposed at the radially inward end of the winding and a leading end which is disposed at the radially outward end of the winding. The reel is supportable in a generally horizontal orientation to allow unwinding of the web from the reel in a controlled, downward spiral under the influence of gravity, upon release of the leading end of the web, to display the images in rapid succession to present an animated motion picture to a viewer.

5 Claims, 2 Drawing Sheets

ANIMATION DEVICE

FIELD OF THE INVENTION

The present invention pertains to motion picture devices, and more particularly, pertains to a device for creating and displaying an animated motion picture.

BACKGROUND OF THE INVENTION

Animated motion pictures, such as cartoons or the like, currently enjoy widespread popularity among both children and adults. There are two well-known devices currently employed for presenting animated motion pictures. A first type of device is of the type disclosed in U.S. Pat. No. 1,787,592 entitled "Motion Picture Device" in which a stack of image-bearing sheets or leaves are riffled along one end by the user's fingers to present a series of successive pictures which create a motion picture to the viewer. This type of device requires skill on the part of the user to riffle the sheet ends individually and in rapid succession from the beginning of the stack to the end, which is particularly difficult for children and the elderly. Even if the user possesses sufficient skill to accurately riffle the sheet ends, only the portion of the sheets adjacent the riffled end is displayed rather than the entire sheets. There is a desire for a device for displaying motion pictures which does not require finger coordination on the part of the user to display images in rapid succession, and which displays the entire sheet rather than just the riffled end of the sheets.

A second type of device is of the movie projector type in which a transparent strip of plastic film having a plurality of successive translucent images is employed. The projector has a light which is shined through the film to project the translucent images onto a screen. To produce the effect of a motion picture, a shutter is opened to allow light to pass through a first image on the film to project the first image onto the screen. The shutter is closed, and the film advanced while the shutter is closed, to bring a second image of the film in front of the light source, and then the shutter is again opened to project the second image onto the screen. The shutter is then closed again, and the film advanced again while the shutter is closed, to bring a third image in front of the light, and the shutter then opened again. By repeating this process rapidly, a series of images are successively displayed on the screen to produce a motion picture. However, movie projectors require a light source and relatively expensive film advancing and synchronizing equipment. Movie projectors also require the formation of translucent images on transparent film, and are therefore limited to films which allow the passage of light therethrough. Still further, special markers or other specialized equipment is required to form translucent images on film for use with movie projectors. It is desirable to provide a motion picture displaying device which is inexpensive, does not require a light source or synchronized equipment and which allows the user to draw the images to be displayed with readily available drawing tools such as crayons, conventional markers, or the like.

SUMMARY OF THE INVENTION

In accordance with the present invention, a device is provided for creating and displaying an animated motion picture which does not use a light source or synchronized machinery so that no power source is required. The device allows the user to customize the image to be displayed with the use of common household items such as crayons, pencils or markers, and also allows the user to display the image without the requirement of particular skill on the part of the user. The device has an elongated web of material with a leading end and a trailing end, which web may be transparent, translucent or opaque. A reel is provided for supporting the web of material in wound configuration thereon, with the trailing end of the web being disposed at the radially inward end of the winding and the leading end of the web being disposed at the radially outward end of the winding. A plurality of images are applied to the web of material at predetermined spaced intervals along the length of the web such that the images line up substantially radially inwardly of, and behind one another, when the web of material is wound onto the reel. Upon release of the leading end of the web, the web falls off of the reel in a downward spiral under the influence of gravity, with the downward spiraling of the web from the reel exposing the plurality of images from the leading end of the web to its trailing end in rapid succession to present an animated motion picture to a viewer. Sheets, such as stickers, may be provided onto which the user can draw a plurality of successive images. A plurality of position-indicating indicia may be provided along the length of the web for indicating positions for attachment of the stickers to the web, with the position-indicating indicia being in predetermined spaced relation from another such that stickers adhered to the web at respective position-indicating indicia align substantially behind one another when the web is wound onto the reel. The reel may be mounted on a rewinding mechanism for simultaneously rolling the web back onto the reel while rotating the reel about itself to unravel the spiralled web as it is being taken up onto the reel.

BRIEF DESCRIPTION OF THE DRAWINGS

In the drawings, wherein like elements are referenced alike.

DETAILED DESCRIPTION OF THE PREFERRED EMBODIMENTS

Figures 1, 2, 3, 4, 5, 6:
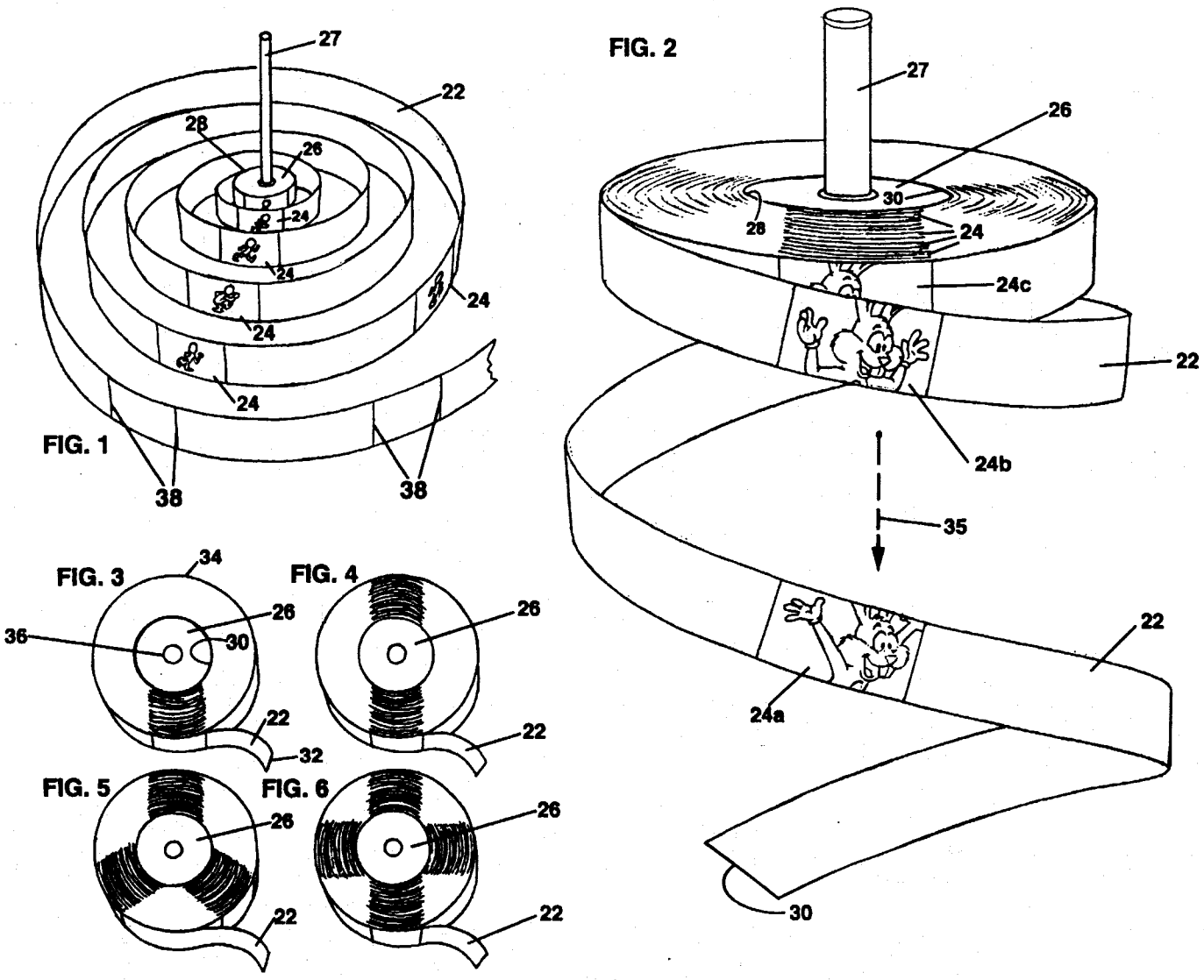
FIG. 1 is a perspective view of an animation device embodying various features of the present invention.
FIG. 2 is an enlarged perspective view of the animation device of FIG. 1, shown with the film unwinding in a spiral from a winding to display the images disposed behind one another in succession.
FIG. 3 is a top, perspective view of the winding of FIG. 2 showing a single sequence of images disposed behind one another.
FIG. 4 is a top, perspective view of an alternative embodiment in which sequential images are disposed behind one another at two separate location about the winding, to display two separate animated motion pictures during unwinding of the film.
FIG. 5 is a top, perspective view of another alternative embodiment in which sequential images are disposed behind one another at three separate location about the winding, to display three separate animated motion pictures during unwinding of the film.
FIG. 6 is a top, perspective view of a still further alternative embodiment in which sequential images are disposed behind one another at four separate location about the winding, to display four separate animated motion pictures during unwinding of the film.

An animation device embodying various features of the present invention is illustrated in FIGS. 1–6 and referred to generally by reference numeral 20. An elongated web or film of material 22 is provided, which may be a length of conventional motion picture film or other flexible material. Advantageously, the film need not be transparent or translucent, as will become apparent as the description of the invention proceeds. A plurality of images 24 are disposed on the film 22 at predetermined, spaced intervals along the length of the film 22 such that the images line up substantially behind one another, and radially inwardly of one another, when the film 22 is wound onto a reel 26, as shown in FIGS. 2 and 3.

With the film 22 wound on the reel 26, the trailing end 28 of the film 22 is disposed at the radially inward end 30 of the winding, and the leading end 32 of the film 22 is disposed at the radially outward end 34 of the film winding. With the winding of film 22 supported on the reel 26 in a generally horizontal orientation, such as by engaging the reel at the lower end of a support rod 27 as illustrated in FIGS. 1 and 2, upon release of the leading end 30 of the film 22, the film 22 unwinds from the reel 26 in a free-falling downward spiral under the influence of gravity in the direction of arrow 35. The downward spiralling of the film 22 from the reel 26 displays the images 24 in rapid succession from the leading end 30 of the film 22 to the trailing end 28 of the film 22 to produce an animated motion picture.

More specifically, with reference to FIG. 2, a first image **24*a* which is disposed most proximately to the leading end 30 of the film 22, and hence disposed most proximately to the outer periphery of the film winding, is displayed first. As the first image 24*a* falls downwardly with the downward spiralling of the film 22, it moves below the second image 24*b* to display the second image 24*b*. As the film 22 continues to unwind from the reel 26 in a downward spiral as depicted in FIG. 2, the second image 24*b* moves below the third image 24*c* to display the third image 24*c*. By making the images 24 successive images from the leading end 30 of the film 22 to the trailing end 28 of the film 22, a motion picture is produced by the display of the successive images. The film unwinds to display the images successively under the influence of gravity so that, unlike the motion picture produced by riffling the ends of a stack of paper, no skill or continual manipulation is required on the part of the user to display the motion picture with the animation device 20** of the present invention.

As the film 22 unwinds from the reel 26 and a given first image **24*a* is displayed, that first displayed image 24*a* remains substantially stationary until the film 22 unwinds approximately 360 degrees about the reel 22, whereupon the first displayed image 24*a* then moves rapidly downwardly to display the next successive image 24*b* disposed immediately behind the previously displayed image 24*a*. The next successive image 24*b* then remains substantially stationary as the film 22 again unwinds around the reel 26**. This produces the desired "flickering effect" of one single image being displayed after another. Since the images remain substantially stationary for a short interval when they are exposed or displayed, prior to their falling downwardly, the images are readily visible prior to their falling downwardly. However, as an image begins to move downwardly, and throughout its downward falling movement, the images appear blurred to the eye of the observer. Hence, crisp, sharp images are observed only at the radial outward end of the aligned images, with the other, falling images being blurred to the observer and thus not contributing or interfering significantly with the visual images being displayed in succession behind one another. Accordingly, the visual effect presented to the viewer is that of a substantially stationary frame with a moving image thereon.

The film 22 is wound about the reel 26 with the film winding being disposed outwardly of the reel 26 so that the reel 26 does not interfere with free falling of the film from the reel. The friction between adjacent windings of the film 22 prevents the film from falling all at once from the reel 26, with the film unwinding at a substantially steady linear rate from its leading end to its trailing end. Manifestly, since the windings of the film about the reel are smaller in the radially inward direction, the images will be displayed with increasing rapidity as the film unwinds from the reel and the diameter of the film winding decreases. As is well known to those skilled in the art of animated motion pictures, this may be easily compensated for by decreasing the amount of variation from one image to the next from the radially outward images to the radially inward images. Also, it will be readily apparent that the larger the film winding, the longer the interval between successive images and therefore the slower the motion of the motion picture which is displayed. Additionally, other factors, such as the weight of the film 22, will affect the rate at which the film 22 unwinds from the reel 26, with heavier films falling faster than lighter films.

In one embodiment, a set of successive, completely pre-drawn and colored images may be supplied for adhering to the film at predetermined intervals. With reference to FIG. 1, the length of film 22 may have identifying indicia 38 such as lines to indicate the location at which the images are to be placed on the film 22 so that they line up substantially one behind the other when the film is wound onto the reel 26. The images may be provided on stickers, with the user transferring the stickers onto the film 22 at its identifying indicia 38 to assure that the stickers, and their respective images, line up one behind the other in the film winding. The stickers may be in a stack or a book to allow the user to riffle the stack of stickers to preliminarily view the images in succession prior to adhering the stickers to the film. Alternatively, stickers having only outlined images may be provided, to allow selective coloring in of the outlined images by the user. As a still further alternative, blank stickers may be provided onto which the user may draw original images to allow the user to completely customize an animated motion picture. Also, images may be drawn directly on the film 22 at predetermined intervals. Manifestly, the invention is not limited to the specific image media discussed herein, and a wide variety of materials and materials for customizing and applying images will be readily apparent to those skilled in the art.

The illustrated reel 26 has an aperture 36, through which the support rod 27 is slidably received. The support rod is enlarged at its lower end so that it does not pass completely through the reel. Thereby, the rod 27 may be gripped at a location above the reel 26, and the reel supported in a substantially horizontal orientation as depicted in FIG. 2. Since the support rod 27 is gripped above the reel 26 and the rod does not extend radially outwardly of the reel, supporting the reel in this manner allows the desired unimpeded, free-fall unwinding of the film 22 from the reel 26.

As illustrated in FIGS. 4–6, images 24 may be disposed on the film 22 at predetermined intervals so that they are disposed behind one another at two separate locations. In the embodiment of FIG. 4, a series of images 24 are disposed behind one another at two peripherally spaced locations 180 degrees apart from one another. The same, or separate, motion pictures may be displayed to viewers observing from either side of the reel of film. In the embodiment of FIG. 4, images 24 are disposed in three groups approximately 120 degrees apart from one another to display three separate, or identical animated motion pictures. Finally, in FIG. 6, the images 24 are disposed on the film 22 at predetermined intervals which produce four separate groups of motion pictures approximately 90 degrees apart from one another.

With a film 22 of substantially uniform thickness, the winding of the film 22 on the reel 26 will be thicker or bulge outwardly at the location of the applied images, such as stickers. Also with a film of uniform thickness, the proper location of the identifying indicia, for assuring that the images line up substantially one behind the other in the winding, will be different in applications in which one motion picture image is to be displayed than in applications in which two or more motion picture images are to be displayed. To prevent bulging out of the winding, and also to assure that the images line up substantially behind one another regardless of the number or location of image-bearing sheets applied to the film, it may be desirable to make the film 22 thicker along its edges than in the intermediate region between the thicker edges at which the images may be applied to the film. With the thickness of the film adjacent its edges being at least as great as the combined thickness of the image-bearing sheets and the thickness of the film at the intermediate region, the film winds on the reel in a circular configuration regardless of the number or position of the image-bearing sheets applied to the film.

It will now be appreciated that the animation device 20 of the present invention lends itself to use with a wide variety of materials for both the film 22 and producing the images 24. For instance, the film 22 may be an elongated length of paper onto which images may be directly drawn in crayon or marker, or the film may be transparent with opaque stickers adhered thereto.

Figure 7:
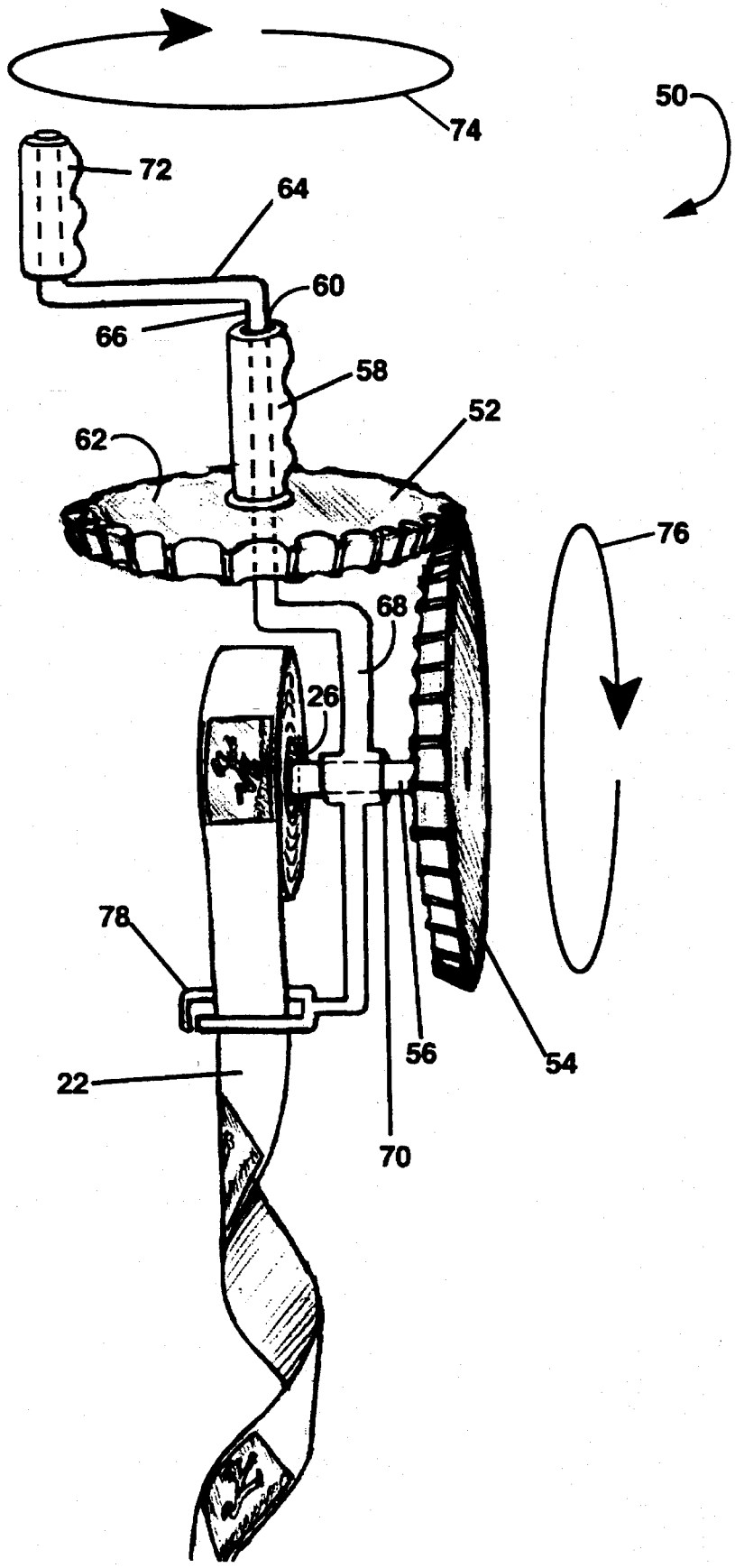
FIG. 7 is a perspective view of a rewind mechanism for simultaneously rewinding the film back onto the reel and spiralling the film to untwist the film as it is being taken up on the reel.

Since the film spirals as it unwinds from the reel 26 and falls down to the floor, after the motion picture has been displayed the length of film 22 is in a spiralled pile or heap on the floor. Therefore, to wind the length of film 22 back onto the reel 26, it is necessary to untwist the film as it is being wound back onto the reel, so that the film is not in a twisted state on the reel 26. To effect untwisting of the film 22 as it is being wound back onto the reel 26, the trailing end 28 of the film 22 may be attached to the reel 26 so that the trailing end 28 of the film 22 remains attached to the reel 26 after the length of film 22 has unwound from the reel 26 and fallen to the floor. The reel 26 is, in turn, detachably connected to a rewind mechanism 50 such as shown in FIG. 7. The rewind mechanism simultaneously rotates the reel 26 about two mutually perpendicular axes to simultaneously untwist the film 22 and wind the film 22 onto the reel 26.

With reference to FIG. 7, the illustrated rewind mechanism 50 comprises a horizontally supported bevel gear 52 and a vertically supported bevel gear 54 which are maintained intermeshed with one another. The reel 26 is mountable on the same axis 56 to which the vertical gear 54 is mounted, so that the reel 26 rotates together with the vertical gear 54. The horizontal gear 52 is maintained stationary as the vertical gear 54 is advanced about the periphery of the horizontal gear 52, and hence rotated about a vertical axis. The advancement of the vertical gear 54 about the vertical axis untwists the film 22. Since the vertical gear 54 is maintained intermeshed with the stationary horizontal gear 52 as it is advanced about the periphery of the horizontal gear 52, the vertical gear 54 rotates as it is advanced about the periphery of the horizontal gear 52, thereby rotating the axis 56 and the reel 26 mounted on the axis 56 to wind the film 22 onto the reel 26 simultaneous with untwisting of the film 22.

More particularly, with continued reference to the illustrated embodiment of FIG. 7, a handle 58 having an aperture 60 is integrally affixed to the horizontal gear 52 and extends upwardly from the upper side 62 of the horizontal gear 52. A serpentine crank arm 64 has an upper vertical portion 66 disposed in the aperture 60 for rotation therein. A lower vertical portion 68 defines an aperture 70 in which the axis 56 is disposed for rotation. The distance of the aperture 70 from the horizontal gear 52 and the size of the vertical gear 54 are proportioned so that the teeth of the vertical gear 54 are maintained intermeshed with the teeth of the horizontal gear 52. With an operator gripping the handle 58 with a first hand to hold the horizontal gear 52 substantially stationary, while also gripping the handle 72 with their other hand, and rotating the handle 72 in the direction of arrow 74, the vertical gear 54 is moved in the direction of arrow 76. The rotation of the crank arm 64 in the direction of arrow 74, i.e. about a vertical axis, rotates the vertical disposed reel 26 to untwist the film 22. The simultaneous rotation of the vertical gear 54 in the direction of arrow 76, i.e. about a horizontal axis, rotates the axis 56, and the reel 26 mounted thereto, to wind the film 22 onto the reel 26 as it is simultaneously being untwisted. An alignment fork 78 may be provided on the crank arm 64 through which the reel passes 22 to assure that the reel 22 is straightened as it is wound onto the reel 26. The alignment fork 78 may have tensioning means for tensioning the reel 22 as it is being wound onto the reel 26 to assure that the film 22 is wound tightly on the reel 26.

What is claimed is:

1. A device for displaying an animated motion picture using a plurality of successive image-bearing elements, the device comprising:

an elongated web of material having a leading end and a trailing end, and having a plurality of placement-identifying indicia in predetermined, spaced relation along the length of the web for indicating positions for attachment of respective ones of said image-bearing elements;

a reel for supporting the web of material in wound configuration on the reel, with the trailing end of the web being disposed at the radially inward end of the winding and the leading end of the web being disposed at the radially outward end of the winding;

the image-bearing elements being mountable to the web at respective locations corresponding to the placement-identifying indicia, and the predetermined, spaced relation of the placement-identifying indicia corresponding to the thickness of the web and the thickness of the image-bearing elements to align the plurality of image-bearing elements substantially behind and radially inwardly of one another;

the reel being supportable in a generally horizontal orientation and the web unwinding from the reel in a downward spiral under the influence of gravity upon release of the leading end of the web to display the image-bearing elements in rapid succession to present an animated motion picture to a viewer.

2. A device in accordance with claim 1 in which the image-bearing elements are stickers.

3. A device in accordance with claim 1 in which the trailing end of the web is attached to the reel and remains attached to the reel after the remainder of the web has unwound from the reel, and the reel is mounted to a rewind mechanism having means for simultaneously rotating the reel about two mutually perpendicular axes to simultaneously untwist the web and wind the web onto the reel.

4. A device in accordance with claim 3 in which the rewind mechanism comprises a pair of mutually perpendicularly disposed intermeshed gears.

5. A device for displaying an animated motion picture, comprising:

an elongated web of material upon which images may be drawn, the web having a leading end and a trailing end and having a plurality of identifying indicia for indicating locations for drawing of images on the web;

a reel for supporting the web of material in wound configuration on the reel, with the trailing end of the web being disposed at the radially inward end of the winding and the leading end of the web being disposed at the radially outward end of the winding;

the identifying indicia being in predetermined, spaced relation along at least a portion of the length of the film so that images drawn on the web at positions corresponding to said identifying indicia line up substantially behind one another and radially inwardly of one another;

the reel being supportable in a generally horizontal orientation with the web wound on the reel, the web unwinding from the reel in a downward spiral under the influence of gravity upon release of the leading end of the web to display the images drawn on the web in succession to present an animated motion picture.

* * * * *